US009062406B2

(12) United States Patent
Back et al.

(10) Patent No.: US 9,062,406 B2
(45) Date of Patent: Jun. 23, 2015

(54) WATER LEVEL/VIBRATION DETECTION APPARATUS FOR WASHING MACHINE AND WASHING MACHINE HAVING THE SAME

(75) Inventors: Dong Il Back, Hwaseong-si (KR); Song Yik Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 580 days.

(21) Appl. No.: 13/311,929

(22) Filed: Dec. 6, 2011

(65) Prior Publication Data

US 2012/0144873 A1 Jun. 14, 2012

(30) Foreign Application Priority Data

Dec. 14, 2010 (KR) ..... 10-2010-0127935

(51) Int. Cl.
*D06F 37/20* (2006.01)
*D06F 39/00* (2006.01)
*D06F 39/08* (2006.01)

(52) U.S. Cl.
CPC ..... *D06F 39/087* (2013.01); *D06F 37/20* (2013.01); *D06F 39/003* (2013.01); *D06F 37/203* (2013.01)

(58) Field of Classification Search
CPC ..... D06F 37/20; D06F 37/203; D06F 39/003; D06F 39/087
USPC ..... 68/12.05, 12.06, 12.21, 23.1
See application file for complete search history.

(56) References Cited

U.S. PATENT DOCUMENTS

| | | | | |
|---|---|---|---|---|
| 6,406,010 | B1 * | 6/2002 | Yano et al. | 267/140.14 |
| 2008/0175727 | A1 * | 7/2008 | Umemura et al. | 417/307 |
| 2010/0170301 | A1 * | 7/2010 | Back et al. | 68/23.1 |

FOREIGN PATENT DOCUMENTS

| | | |
|---|---|---|
| JP | 9-94380 | 4/1997 |
| JP | 9-294892 | 11/1997 |
| KR | 2001-0049030 | 6/2001 |

OTHER PUBLICATIONS

Chinese Office Action dated Jan. 7, 2015 in corresponding Chinese Patent Application No. 201110416635.6.

* cited by examiner

*Primary Examiner* — Joseph L Perrin
*Assistant Examiner* — Levon J Shahinian
(74) *Attorney, Agent, or Firm* — Staas & Halsey LLP

(57) ABSTRACT

A water-level/vibration detection apparatus includes a diaphragm adapted to be moved by air pressure applied through an air hose and a core slidably placed on a support shaft of the diaphragm while being elastically supported by an elastic member. The water-level/vibration detection apparatus detects the level of water and vibration via movement of the core into a coil which constitutes a resonance circuit.

19 Claims, 7 Drawing Sheets

WATER LEVEL/VIBRATION DETECTION APPARATUS FOR WASHING MACHINE AND WASHING MACHINE HAVING THE SAME

CROSS-REFERENCE TO RELATED APPLICATIONS

This application claims the benefit of Korean Patent Application No. 2010-0127935, filed on Dec. 14, 2010 in the Korean Intellectual Property Office, the disclosure of which is incorporated herein by reference.

BACKGROUND

1. Field

Embodiments of the present disclosure relate to a water-level/vibration detection apparatus suitable for simultaneously detecting water-level and vibration of a washing machine and a washing machine having the same.

2. Description of the Related Art

Generally, a washing machine generates a stream of water by rotating a pulsator using a motor, thereby realizing washing of laundry as the stream of water applies shock to the laundry.

The washing machine typically sequentially performs washing, rinsing and dehydration operations.

In the washing operation, laundry is washed via friction between the laundry and a stream of water generated when the pulsator is rotated in a state in which wash water and detergent have been fed into a water tub.

In the rinsing operation, after the used wash water is drained from the water tub after completion of the washing operation, fresh (clean) water is fed into the water tub and a rotating tub is rotated several turns. The above described cycle is repeated plural times and finally, the wash water is drained from the water tub.

In the dehydration operation, the water tub is rotated at a high speed to remove wash water remaining in the laundry.

The washing machine includes a water-level detection apparatus to detect the level of wash water in the water tub. The water-level detection apparatus allows an appropriate amount of wash water to be fed based on the amount of laundry in the water tub during water-supply and rinsing operations.

In addition, the dehydration operation may require a vibration detection apparatus to detect unbalance caused by eccentric rotation of the rotating tub when laundry accumulates at one side.

Recently, to reduce complexity, time and costs required to separately install the water-level detection apparatus and the vibration detection apparatus, an apparatus to detect both the level of water and vibration has been studied.

SUMMARY

It is an aspect of the present disclosure to provide a water-level/vibration detection apparatus to accurately detect the level of water and vibration simultaneously and a washing machine having the same.

Additional aspects of the disclosure will be set forth in part in the description which follows and, in part, will be apparent from the description, or may be learned by practice of the disclosure.

In accordance with one aspect of the disclosure, a washing machine includes a water tub, a rotating tub rotatably installed in the water tub, and a water-level/vibration detection apparatus connected to an air hose communicating with the water tub and serving to detect the level of water and vibration of the water tub, wherein the water-level/vibration detection apparatus includes a housing having a compression chamber communicating with the air hose, a bobbin placed in the housing, on an outer circumference of which a coil to create a resonance circuit is supported, a diaphragm, both ends of which are supported by coil springs, the diaphragm having a support shaft to be moved in the bobbin based on a change in pressure within the compression chamber, a core placed on an outer surface of the support shaft so as to be slidably moved on the support shaft, and an elastic member placed on the support shaft to elastically support the core, the elastic member having elastic restoration force less than that of the coil springs.

The water-level/vibration detection apparatus may further include an expandable bellows coupled to the diaphragm so as to define the compression chamber, and the coil springs may include a first coil spring interposed between one end of the housing and the diaphragm and a second coil spring interposed between the other end of the housing and the support shaft, the first and second coil springs having the same modulus of elasticity.

The support shaft may be provided at an end thereof with a holder having a diameter greater than that of the support shaft so as to support the second coil spring, the core may be placed on the support shaft so as to be spaced apart from the holder, and the elastic member may be interposed between the holder and the core spaced apart from each other.

The elastic member may be made of a non-magnetic material.

The elastic member may include a coil spring.

The elastic member may include a leaf spring.

The water-level/vibration detection apparatus may be secured to an outer surface of the water tub such that a movement direction of the core intersects an axial direction of the rotating tub.

The water-level/vibration detection apparatus may detect the level of wash water via a frequency of the resonance circuit depending on a position change of the diaphragm as the diaphragm is moved by the change in pressure within the compression chamber.

The water-level/vibration detection apparatus may detect vibration via a frequency of the resonance circuit depending on a position change of the core as the core is moved on the support shaft when external force is applied.

In accordance with another aspect of the present disclosure, a water-level/vibration detection apparatus includes a housing having an air inlet and a sealed compression chamber communicating with the air inlet, a bobbin, on an outer circumference of which a coil to create a resonance circuit is supported, an expandable bellows forming one side of the compression chamber, a diaphragm coupled to the bellows and having a support shaft to be moved in the bobbin based on a change in pressure within the compression chamber, coil springs supported respectively at opposite ends of the diaphragm to enable linear movement of the diaphragm, a core placed on an outer surface of the support shaft so as to be slidably moved on the support shaft when external force is applied to the housing, and an elastic member placed on the support shaft to return the core moved by the external force to an original position thereof, the elastic member having elastic restoration force less than that of the coil springs.

The core may be moved along with the diaphragm when the diaphragm is moved by air pressure applied through the air inlet, and when the external force is applied, the diaphragm may not be moved and only the core may be moved on the support shaft.

The elastic member may include a coil spring.

The elastic member may include a leaf spring.

The coil springs respectively supported at opposite ends of the diaphragm may have the same modulus of elasticity.

The air pressure applied through the air inlet may correspond to water pressure within the water tub.

The level of water may be detected via a change in the frequency of a resonance circuit depending on a position change of the core moving along with the diaphragm, and vibration may be detected via a change in the frequency of the resonance circuit depending on a position change of the core moving on the shaft.

The coil springs may include a first coil spring interposed between the housing and the diaphragm and a second coil spring interposed between the housing and the support shaft, the support shaft may extend from the center of the diaphragm toward an interior space of the bobbin and may be provided at one end thereof with a holder to support the second coil spring, and the core may be spaced apart from the holder on the support shaft to define a space for movement of the core, and the elastic member may be interposed between the core and the holder spaced apart from each other.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
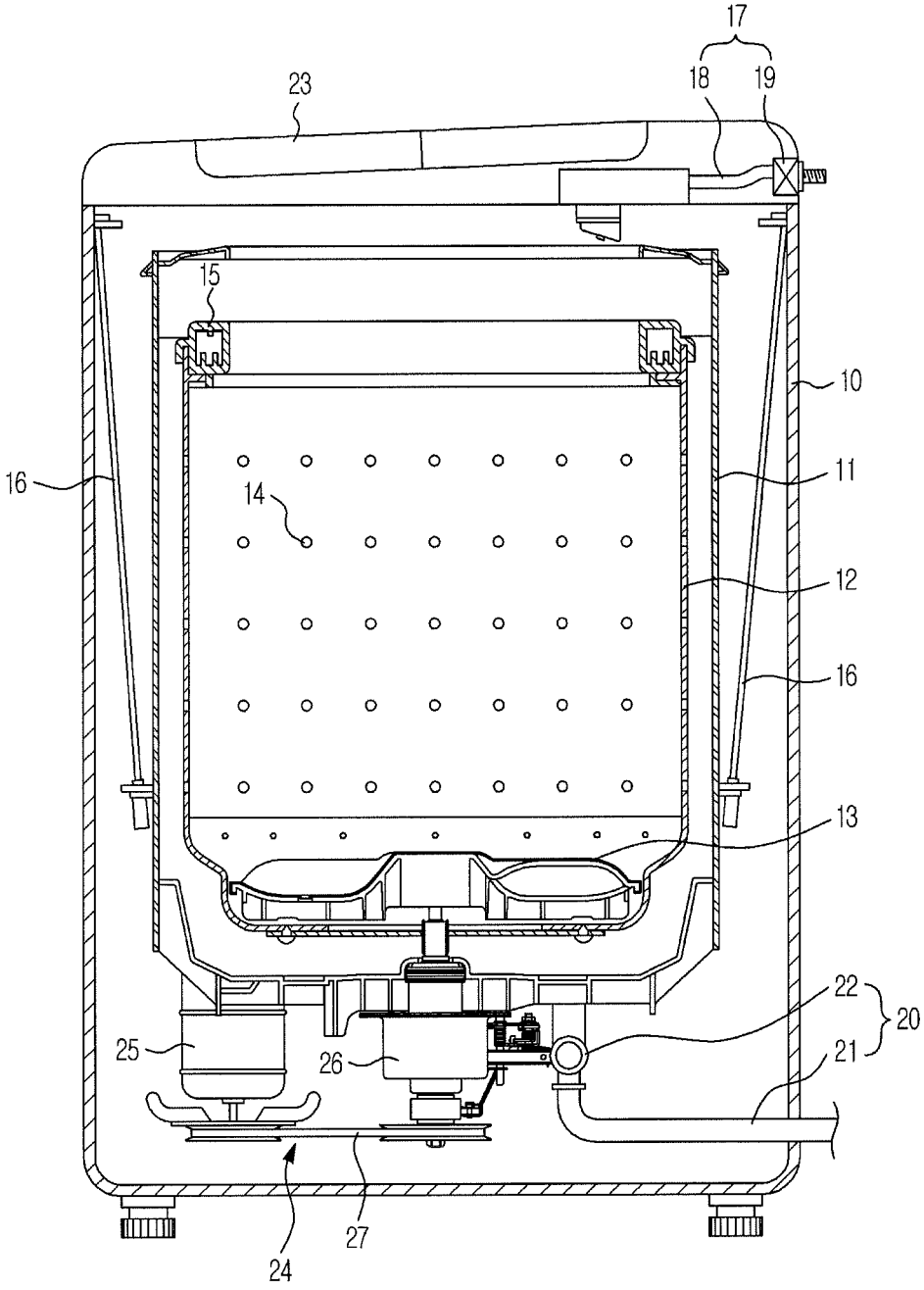
FIG. 1 is a sectional view illustrating a schematic configuration of a washing machine according to an embodiment of the present disclosure.

Reference will now be made in detail to the exemplary embodiment of the present disclosure, examples of which are illustrated in the accompanying drawings, wherein like reference numerals refer to like elements throughout.

Figure 2:
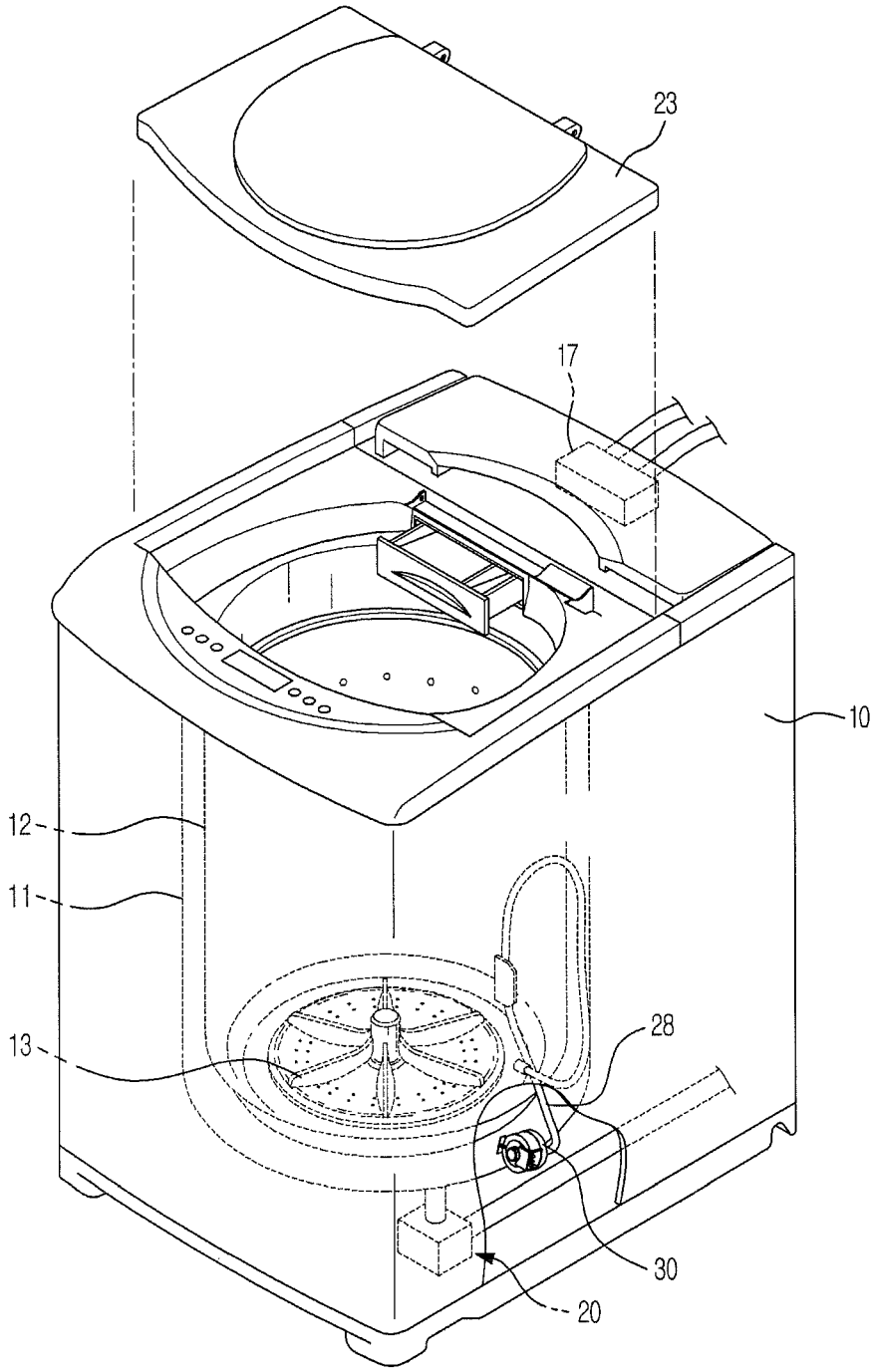
FIG. 2 is a perspective view of the washing machine according to the embodiment of the present disclosure.

FIG. 1 is a sectional view illustrating a schematic configuration of a washing machine according to an embodiment of the present disclosure, and FIG. 2 is a perspective view of the washing machine according to the embodiment of the present disclosure.

First, it is noted that the embodiment of the present disclosure explains a pulsator type washing machine, but may be applied to a drum type washing machine.

Referring to FIGS. 1 and 2, the washing machine according to the embodiment may include a water tub 11 placed in a main body 10, in which wash water is stored, a rotating tub 12 rotatably placed in the water tub 11, and a pulsator 13 mounted in the rotating tub 12 to agitate wash water and laundry.

A suspension device 16, an upper end of which is caught and supported by the inner ceiling of the main body 10, is used to catch and support the water tub 11. To this end, a lower end of the suspension device 16 is connected to a lower portion of an outer surface of the water tub 11.

A water supply device 17 may be provided above the water tub 11 to supply wash water into the water tub 11. The water supply device 17 may include a water supply pipe 18 and a water supply valve 19. Also, a drain device 20 may be provided below the water tub 11 to discharge the wash water from the water tub 11. The drain device 20 may include a drain pipe 21, a drain valve 22, and a drain motor (not shown).

The rotating tub 12 is a cylindrical tub, the top of which is open, and has a plurality of water discharge holes 14 perforated in a wall thereof. A general balancer 15 may be installed on the rotating tub 12 to ensure that the rotating tub 12 stably rotates at a high speed.

A door 23 to open or close the open top side of the rotating tub 12 may be installed to an upper end of the main body 10. The pulsator 13 to create a stream of wash water may be rotatably mounted on a bottom surface of the rotating tub 12.

In addition, the washing machine includes a drive device 24 to rotate the pulsator 13.

The drive device 24 may include a motor 25 installed below the water tub 11, a power transmission device 26 to selectively transmit rotational power of the motor 25 to the rotating tub 12 and the pulsator 13, and a belt 27 to transmit power from the motor 25 to the power transmission device 26.

The power transmission device 26 may be a general clutch device to rotate the pulsator 13 at a reduced speed or rotate the rotating tub 12 when power of the motor 25 is transmitted thereto.

Although the drive device to rotate the pulsator has been described in the embodiment as including the clutch device, a direct drive device in which a motor directly rotates a pulsator may be employed.

Referring to FIG. 2, a water-level/vibration detection apparatus 30 may be installed to a lower position of the outer surface of the wash tub 11. The water-level/vibration detection apparatus 30 serves to detect the level of wash water in the water tub 11 or vibration caused by eccentric rotation of the rotating tub 12 when laundry accumulates at one side.

Although the water-level/vibration detection apparatus 30 installed to the water tub 11 has been described in the present embodiment, the water-level/vibration detection apparatus 30 may be installed to the main body 10.

The water-level/vibration detection apparatus 30 may be connected to one end of an air hose 28 filled with air, the other end of the air hose 28 may communicate with the water tub 11.

The water-level/vibration detection apparatus 30 may include a water-level sensor, which detects the level of water in the water tub 11 by measuring a change in frequency depending on an air pressure applied through the air hose 28 as the water tub 11 is gradually filled with water.

Figure 3:
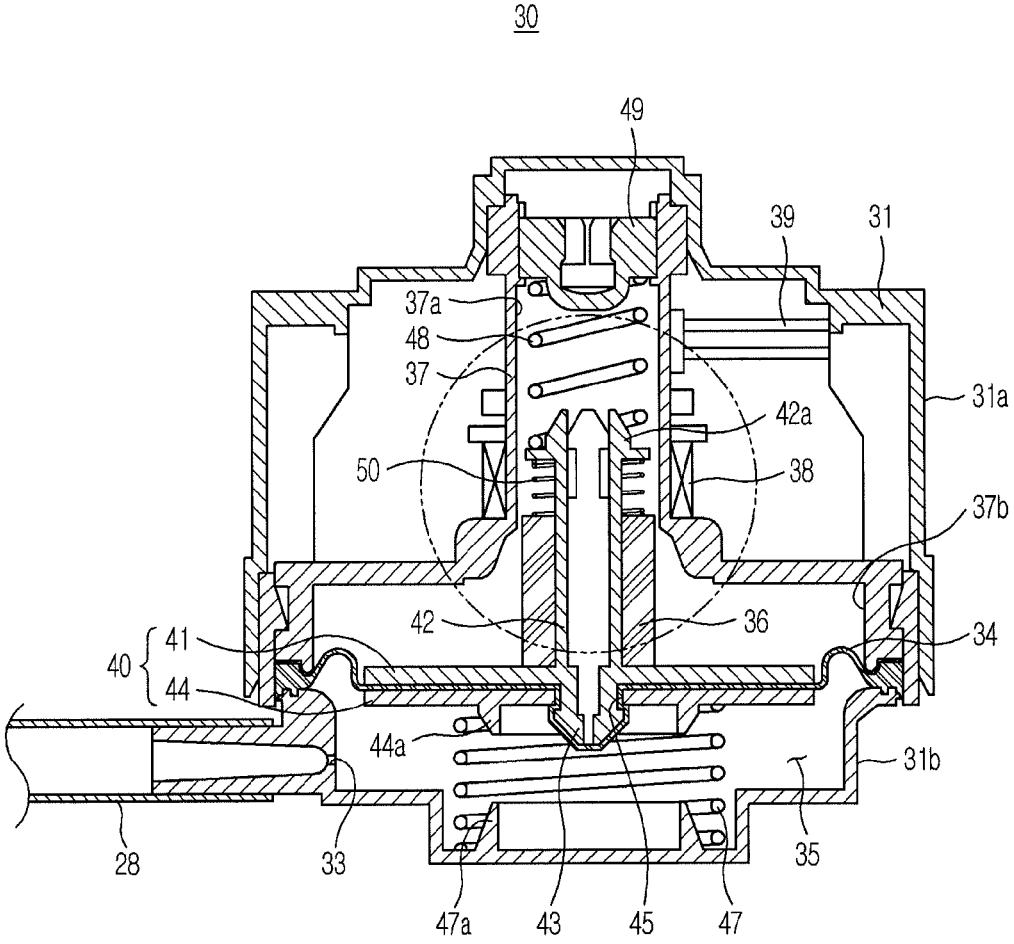
FIG. 3 is a sectional view illustrating a water-level/vibration detection apparatus usable with the washing machine according to an embodiment of the present disclosure.

FIG. 3 is a sectional view of the water-level/vibration detection apparatus usable with the washing machine.

As illustrated in FIG. 3, the water-level/vibration detection apparatus 30 may include a housing 31 defining an external appearance of the apparatus 30. The housing 31 includes a cylindrical case 31*a* having an open end and a case cover 31*b* to seal the open end of the case 31*a*.

The case cover 31*b* may have an air inlet 33, into which air from the air hose 28 is introduced. A bellows 34 may be installed at a coupling region between the case cover 31*b* and the case 31*a*. The bellows 34 is expandable based on the air pressure applied through the air hose 28.

The bellows 34 is hermetically installed to prevent loss of the air pressure applied through the air inlet 33, providing a compression chamber 35 between the air inlet 33 and the bellows 34.

A diaphragm 40 may be installed at the center of the bellows 34 so as to be vertically moved in the housing 31 as the bellows 34 is expanded or contracted.

The diaphragm 40 may include an upper diaphragm 41 provided with a hook 43 and a lower diaphragm 44 provided with a hook coupling hole 45. The upper diaphragm 41 and the lower diaphragm 44 are hook-coupled to each other from the upper and lower sides of the bellows 34 with the bellows 34 interposed therebetween.

Both ends of the diaphragm 40 may be supported respectively by coil springs 47 and 48. The coil springs 47 and 48 may include a first coil spring 47, which is interposed between the case cover 31*b* and the lower diaphragm 44 to elastically support the same, and a second coil spring 48 which is interposed between the case 31*a* and the upper diaphragm 41 to elastically support the same.

The first and second coil springs 47 and 48 may have the same modulus of elasticity to exhibit linear characteristics when the diaphragm 40 is moved by a change in pressure within the compression chamber 35.

These coil springs 47 and 48 may be made of a non-magnetic material, such as rubber or resin.

A cylindrical support shaft 42 may be installed at the center of the diaphragm 41, and a ferrite core 36 may be installed around an outer circumference of the support shaft 42.

The support shaft 42 may extend upward from the center of the upper diaphragm 41 and may be provided at an end thereof with a holder 42*a* to support one end of the second coil spring 48.

A bobbin 37 may be centrally placed in the case 31*a* to define a space in which the support shaft 42 is movably inserted.

The bobbin 37 may include a small-diameter portion 37*a* in which the support shaft 42 is inserted and moved and a large-diameter portion 37*b* in which the diaphragm 40 is inserted and moved.

The small-diameter portion 37*a* may extend parallel to a movement direction of the core 36 to allow the core 36 to be moved based on a change in pressure within the compression chamber 35.

The large-diameter portion 37*b* has a greater diameter than the diaphragm 40 to allow movement of the diaphragm 40. An outer rim of the bellows 34 is interposed between the large-diameter portion 37*b* and the case cover 31*b*.

A coil 38 may be provided around an outer circumference of the small-diameter portion 37*a*. The coil 38 constitutes a resonance circuit along with a condenser (not shown). In addition, a terminal 39 may be provided above the coil 38 and be coupled to a cable connected to a control unit (not shown).

An upper end of the small-diameter portion 37*a* is fixed to the case 31*a* using a fastening bolt 49. The second elastic member 48 is accommodated in the small-diameter portion 37*a* such that both ends of the second elastic member 48 are supported respectively by the fastening bolt 49 and the holder 42*a*.

The lower diaphragm 44 may be provided at the center of a lower surface thereof with a spring support 44*a* to support one end of the first coil spring 47. A spring support 47*a* to support the other end of the first coil spring 47 may protrude from a position of the case cover 31*b* facing the spring support 44*a*.

With the above-described configuration, the diaphragm 40 is moved by the air pressure applied to the compression chamber 35 through the air hose 28, causing the core 36 coupled to the support shaft 42 to be reciprocally moved in the small-diameter portion 37*a*. Reciprocation of the core 36 changes the inductance of the coil 38, thus causing a change in the frequency of the resonance circuit including the coil 38 and the condenser (not shown). As such, the level of water in the washing machine may be measured based on a change in output frequency.

Additionally, the water-level/vibration detection apparatus 30 according to the embodiment may function to detect unbalance of the rotating tub 12 caused when laundry accumulates at one side.

Figure 4:
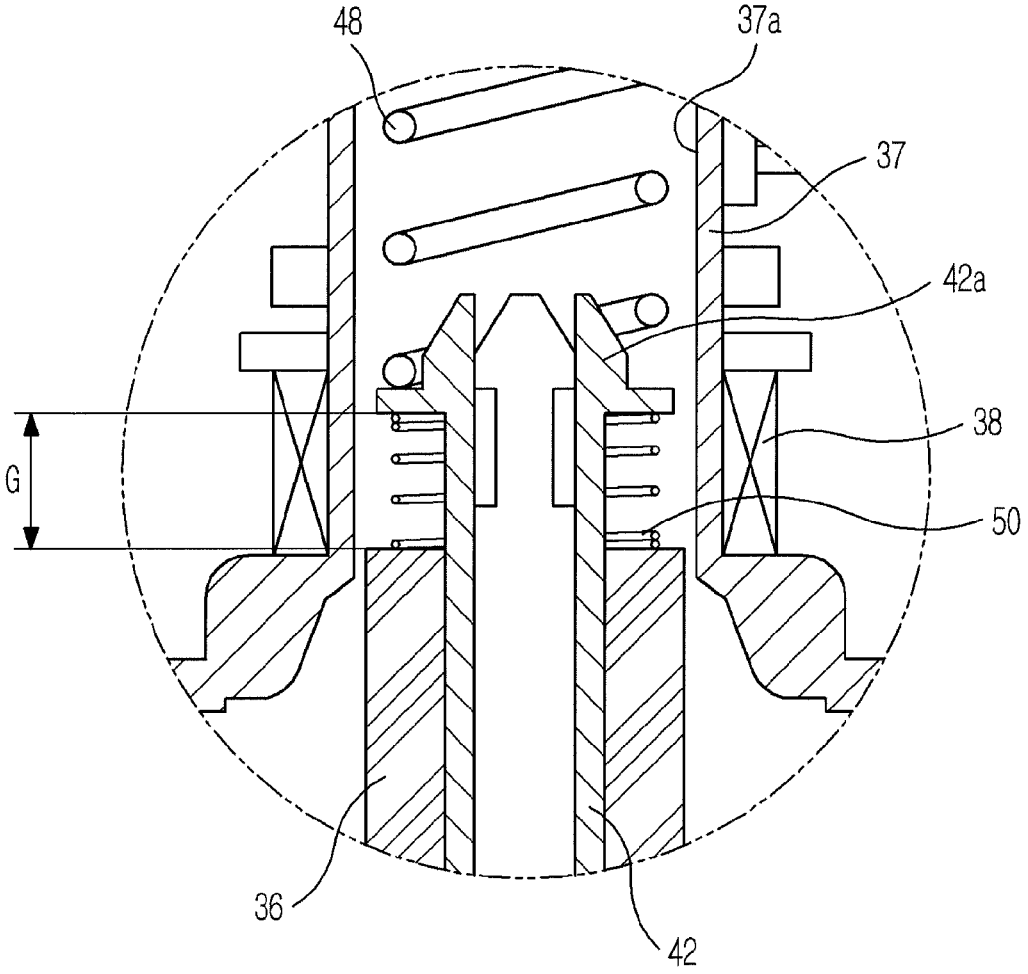
FIG. 4 is an enlarged view of the circle of FIG. 3.

FIG. 4 is an enlarged view of the circle of FIG. 3, illustrating a part of the water-level/vibration detection apparatus. As illustrated in FIG. 4, a mechanism to detect vibration may include the core 36 which is supported by an elastic member 50 while being slidably coupled to the support shaft 42.

The core 36 takes the form of a hollow cylinder such that the support shaft 42 is inserted into the core 36. The core 36 has a longitudinal length less than a length of the support shaft 42.

Thus, when the core 36 is placed on the support shaft 42, a predetermined gap G is defined between the core 36 and the holder 42*a*, providing a space for movement of the core 36.

The elastic member 50 is accommodated in the gap G between the holder 42*a* and the core 36 such that both ends thereof are respectively supported by the holder 42*a* and the core 36.

The elastic member 50 may function to keep the core 36 in a fixed position on the support shaft 42 when the diaphragm 40 is moved by a change in pressure within the compression chamber 35. This serves to prevent defective detection of the level of water due to movement of the core 36.

The elastic member 50 may have elastic restoration force less than that of the first and second coil springs 47 and 48 which support both ends of the diaphragm 40.

This allows movement of only the core 36 supported by the elastic member 50 having elastic restoration force less than that of the first and second coil springs 47 and 48 when predetermined external force is applied to the housing 31.

More specifically, if force, which is less than elastic restoration force of the first and second coil springs 47 and 48 and greater than elastic restoration force of the elastic member 50, is applied, the diaphragm 40 is not moved and only the core 36 is moved on the support shaft 42, causing a change in the frequency of the resonance circuit. As such, unbalance of the washing machine is detected.

In this case, the elastic member 50 functions to return the core 36 moved on the support shaft 42 to an original position thereof.

The elastic member 50 may be made of a non-magnetic material. Also, the elastic member 50 may be a coil spring or a leaf spring. Of course, the kind of the elastic member 50 is not limited so long as the elastic member 50 functions to return the moved core 36 to an original position thereof.

The water-level/vibration detection apparatus 30 installed to the water tub 11 or the main body 10 may be oriented in a direction perpendicular to an axial direction of the rotating tub 12, to enhance reliability in the detection of unbalance due to vibration.

More specifically, when the water-level/vibration detection apparatus 30 is installed to the water tub 11 or the main body 10 such that the support shaft 42 placed in the housing 31 extends in a direction perpendicular to the axial direction of the rotating tub 12, the core 36 may be easily moved by vibration, enabling accurate detection of unbalance.

Figure 5:
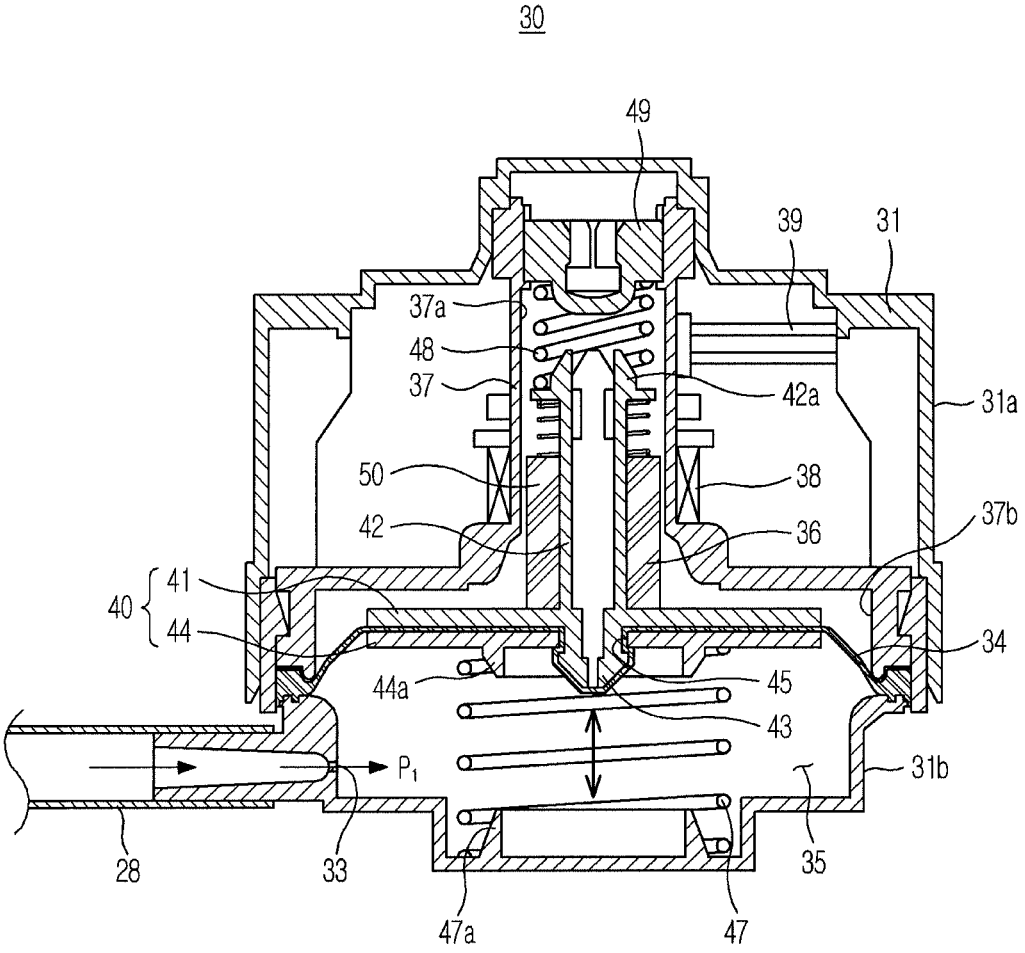
FIG. 5 is a view illustrating a water-level detecting operation of the water-level/vibration detection apparatus according to the embodiment of the present disclosure.
Figure 6:
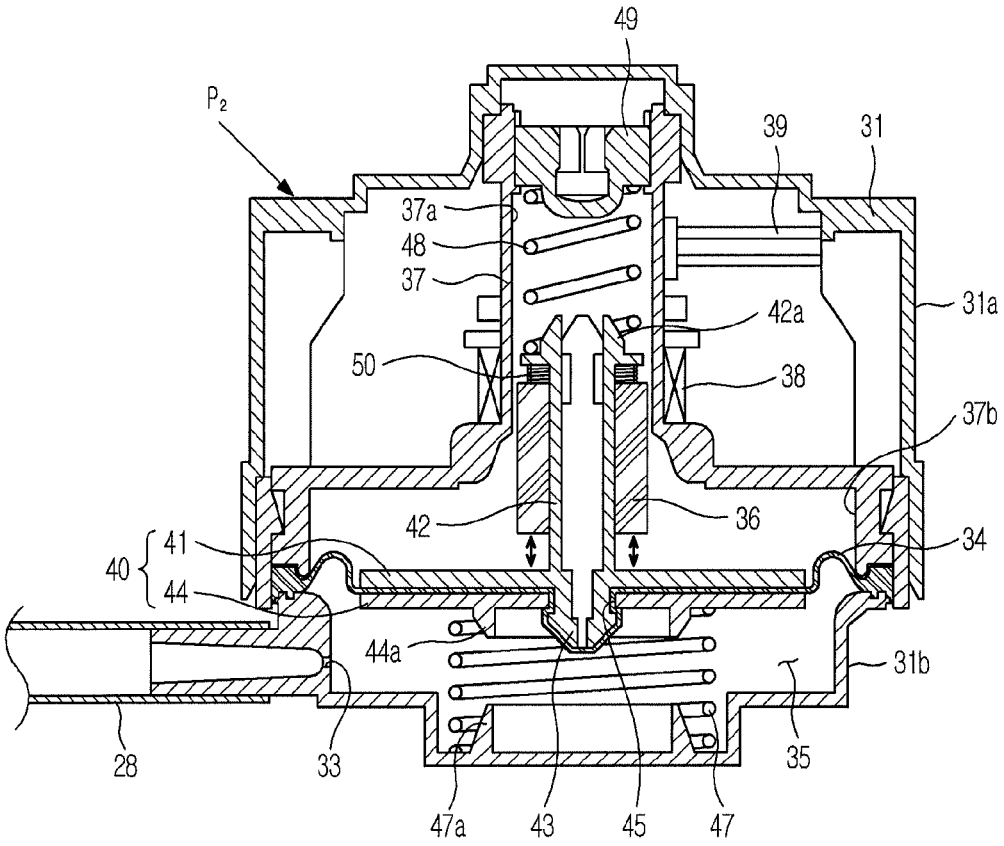
FIG. 6 is a view illustrating a vibration detecting operation of the water-level/vibration detection apparatus according to the embodiment of the present disclosure.
Figure 7:
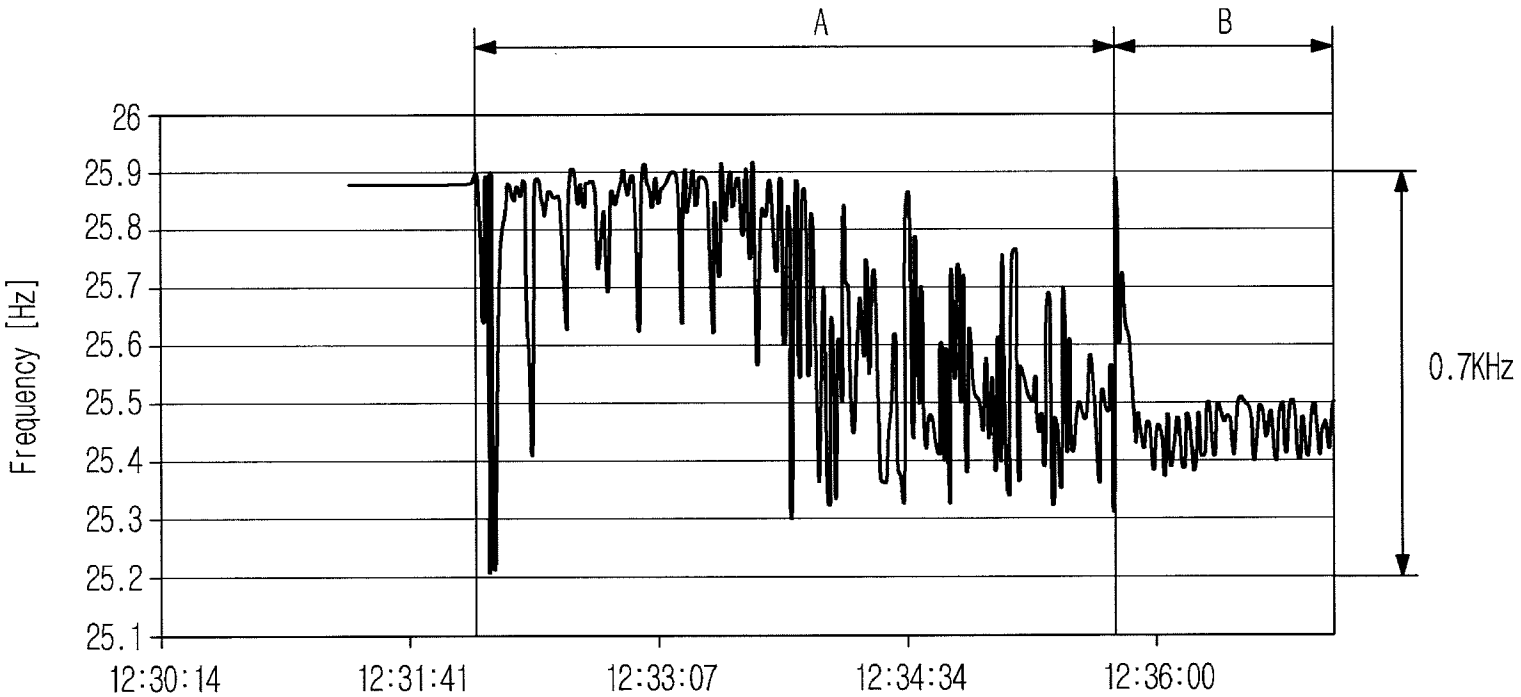
FIG. 7 is a graph illustrating distribution of frequency under unbalance of the washing machine according to the embodiment of the present disclosure.

Hereinafter, operation and effects of the water-level/vibration detection apparatus 30 according to the embodiment will be described with reference to FIGS. 1 to 7. FIG. 5 is a view illustrating a water-level detection operation of the water-level/vibration detection apparatus according to the embodiment of the present disclosure, FIG. 6 is a view illustrating a vibration detection operation of the water-level/vibration detection apparatus according to the embodiment of the present disclosure, and FIG. 7 is a graph illustrating distribution of frequency by unbalance of the washing machine according to the embodiment.

First, the water-level detection operation of the water-level/vibration detection apparatus 30 will be described.

During a washing mode and a rinsing operation of the washing machine, the water supply device 17 is operated to supply wash water into the water tub 11.

The level of wash water in the water tub 11 rises as the supply of water progresses, and the pressure of wash water is applied to the air inlet 33 through the air hose 28.

The air pressure P1 applied to the air inlet 33, as illustrated in FIG. 5, increases the pressure of the compression chamber 35 inside the bellows 34, causing the bellows 34 to expand.

Simultaneously with expansion of the bellows 34, the diaphragm 40 coupled to the bellows 34 is moved upward, causing the core 36 coupled to the diaphragm 40 to move into the interior space of the coil 38.

The coil 36 moved into the coil 38 changes the inductance of the coil 38. Here, the changed inductance times the capacitance of the condenser (not shown) is frequency.

The control unit (not shown) may control whether or not to supply water by comparing a measured frequency value with a preset frequency value corresponding to the level of water based on the amount of laundry.

The core 36 coupled to the support shaft 42 is kept pressed by the elastic member 50. Thus, the core 36 is not further moved during the water level detection operation.

Next, the vibration detection operation of the water-level/vibration detection apparatus 30 according to the embodiment will be described.

During a dehydration operation, the pressure of the compression chamber 35 drops after the wash water is completely drained from the water tub 11, causing the diaphragm 40 to be returned to an original position thereof by the first and second coil springs 47 and 48.

If laundry is evenly distributed in the rotating tub 12 during the dehydration operation, the rotating tub 12 placed in the water tub 11 is concentrically rotated about a rotating shaft thereof, keeping balance thereof.

However, if laundry accumulates at one side of the rotating tub 12, the rotating tub 12 rotates eccentrically. If the eccentric rotation excessively increases, the rotating tub 12 becomes unbalanced, thus colliding with the water tub 11.

When the rotating tub 12 is unbalanced, as illustrated in FIG. 6, shock P2 is applied to the water-level/vibration detection apparatus 30 installed to the water tub 11.

When the shock is applied to the water-level/vibration detection apparatus 30, the core 36, which is slidably coupled to the support shaft 42 while being elastically supported by the elastic member 50, is moved, causing a change in the inductance of the coil 38. This results in a change in output frequency as illustrated in FIG. 7 (A section).

Specifically, as only the core 36 coupled to the support shaft 42 is moved in a state in which the diaphragm 40 supported by the first and second coil springs 47 and 48 is not moved, the unbalance and a so-called "walking" mode of the washing machine may be detected based on a change in output frequency.

Here, the "walking" mode means that vibration occurs due to accumulation of laundry at one side during a dehydration operation and laundry is dehydrated under maintenance of vibration, causing movement of the main body 10.

Although the "walking" mode does not cause collision between the main body 10 and the water tub 11, a left-and-right or front-and-rear movement amplitude of the main body 10 causes movement of the core 36 coupled to the support shaft 42 of the water-level/vibration detection apparatus 30. As such, the core 36 acts to change the inductance of the coil 38, resulting in a change in output frequency.

In this case, as the core 36 is successively reciprocated about the support shaft 42, the frequency is successively changed, thus enabling detection of the "walking" mode.

As is apparent from the above description, one or more embodiments include a water-level/vibration detection apparatus and a washing machine having the same, the water-level/vibration detection apparatus functioning to simultaneously detect the level of water and vibration of the washing machine with a simplified configuration without requiring additional vibration detection elements, thereby achieving enhanced productivity and enabling accurate detection of malfunction of the washing machine.

Although the embodiment of the present disclosure has been shown and described, it will be appreciated by those skilled in the art that changes may be made in these embodiments without departing from the principles and spirit of the invention, the scope of which is defined in the claims and their equivalents.

What is claimed is:

1. A washing machine comprising:

a water tub;

a rotating tub rotatably installed in the water tub; and a water-level/vibration detection apparatus connected to an air hose communicating with the water tub and serving to detect the level of water and vibration of the water tub, wherein the water-level/vibration detection apparatus includes a housing having a compression chamber communicating with the air hose;

a bobbin placed in the housing, on an outer circumference of which a coil to create a resonance circuit is supported;

a diaphragm, both ends of which are supported by coil springs, the diaphragm having a support shaft to be moved in the bobbin based on a change in pressure within the compression chamber;

a core placed on an outer surface of the support shaft so as to be slidably moved on the support shaft, the core being configured to move independently of the diaphragm; and an elastic member placed on the support shaft to elastically support the core, the elastic member having elastic restoration force less than that of the coil springs.

2. The washing machine according to claim 1, wherein the water-level/vibration detection apparatus further includes an expandable bellows coupled to the diaphragm so as to define the compression chamber; and the coil springs include a first coil spring interposed between one end of the housing and the diaphragm and a second coil spring interposed between the other end of the housing and the support shaft, the first and second coil springs having the same modulus of elasticity.

3. The washing machine according to claim 2, wherein the support shaft is provided at an end thereof with a holder having a diameter greater than that of the support shaft so as to support the second coil spring, the core is placed on the support shaft so as to be spaced apart from the holder, and the elastic member is interposed between the holder and the core spaced apart from each other.

4. The washing machine according to claim 2, wherein the elastic member is made of a non-magnetic material.

5. The washing machine according to claim 4, wherein the elastic member includes a coil spring.

6. The washing machine according to claim 4, wherein the elastic member includes a leaf spring.

7. The washing machine according to claim 1, wherein the water-level/vibration detection apparatus is secured to an outer surface of the water tub such that a movement direction of the core intersects an axial direction of the rotating tub.

8. The washing machine according to claim 1, wherein the water-level/vibration detection apparatus detects the level of wash water via a frequency of the resonance circuit depending on a position change of the diaphragm as the diaphragm is moved by the change in pressure within the compression chamber.

9. The washing machine according to claim 1, wherein the water-level/vibration detection apparatus detects vibration via a frequency of the resonance circuit depending on a position change of the core as the core is moved on the support shaft when external force is applied.

10. A water-level/vibration detection apparatus comprising:

a housing having an air inlet and a sealed compression chamber communicating with the air inlet;

a bobbin, on an outer circumference of which a coil to create a resonance circuit is supported;

an expandable bellows forming one side of the compression chamber;

a diaphragm coupled to the bellows and having a support shaft to be moved in the bobbin based on a change in pressure within the compression chamber;

coil springs supported respectively at opposite ends of the diaphragm to enable linear movement of the diaphragm;

a core placed on an outer surface of the support shaft so as to be slidably moved on the support shaft when external force is applied to the housing, the core being configured to move independently of the diaphragm; and an elastic member placed on the support shaft to return the core moved by the external force to an original position thereof, the elastic member having elastic restoration force less than that of the coil springs.

11. The apparatus according to claim 10, wherein the core is moved along with the diaphragm when the diaphragm is moved by air pressure applied through the air inlet, and when the external force is applied, the diaphragm is not moved and only the core is moved on the support shaft.

12. The apparatus according to claim 11, wherein the air pressure applied through the air inlet corresponds to water pressure within the water tub.

13. The apparatus according to claim 11, wherein the level of water is detected via a change in the frequency of a resonance circuit depending on a position change of the core moving along with the diaphragm; and vibration is detected via a change in the frequency of the resonance circuit depending on a position change of the core moving on the support shaft.

14. The washing machine according to claim 10, wherein the elastic member includes a coil spring.

15. The washing machine according to claim 10, wherein the elastic member includes a leaf spring.

16. The washing machine according to claim 10, wherein the coil springs respectively supported at opposite ends of the diaphragm have the same modulus of elasticity.

17. The apparatus according to claim 16, wherein the coil springs include a first coil spring interposed between the housing and the diaphragm and a second coil spring interposed between the housing and the support shaft;

the support shaft extends from the center of the diaphragm toward an interior space of the bobbin and is provided at one end thereof with a holder to support the second coil spring; and the core is spaced apart from the holder on the support shaft to define a space for movement of the core, and the elastic member is interposed between the core and the holder spaced apart from each other.

18. The apparatus according to claim 10, wherein the core comprises a hollow cylinder such that the support shaft is inserted into the core, the core having a longitudinal length less than a length of the support shaft.

19. The apparatus according to claim 10, wherein the support shaft includes a holder provided at an end thereof to support one end of one of the coil springs.

* * * * *